US012365427B2

(12) United States Patent
Mejia

(10) Patent No.: US 12,365,427 B2
(45) Date of Patent: Jul. 22, 2025

(54) INFLATABLE LIFT ASSEMBLY

(71) Applicant: Rony Mejia, Fort Lauderdale, FL (US)

(72) Inventor: Rony Mejia, Fort Lauderdale, FL (US)

( * ) Notice: Subject to any disclaimer, the term of this patent is extended or adjusted under 35 U.S.C. 154(b) by 202 days.

(21) Appl. No.: 18/220,744

(22) Filed: Jul. 11, 2023

(65) Prior Publication Data

US 2025/0019054 A1 Jan. 16, 2025

(51) Int. Cl.
*B63C 3/06* (2006.01)

(52) U.S. Cl.
CPC ..... *B63C 3/06* (2013.01)

(58) Field of Classification Search
CPC ..... B63C 3/06
See application file for complete search history.

(56) References Cited

U.S. PATENT DOCUMENTS

| | | | | |
|---|---|---|---|---|
| 3,797,435 | A * | 3/1974 | Dunson | B63B 43/14 114/68 |
| 5,341,756 | A * | 8/1994 | Hinze | B63B 59/00 114/54 |
| 5,664,513 | A | 9/1997 | Echelbarger | |
| 5,860,379 | A * | 1/1999 | Moody | B63C 1/06 114/45 |
| 6,032,601 | A | 3/2000 | Gates | |
| 6,408,782 | B1 * | 6/2002 | Mitchell | B63B 43/14 114/44 |
| 7,503,274 | B2 | 3/2009 | Weed | |
| 8,997,673 | B1 * | 4/2015 | Moseley | B63B 43/14 114/68 |
| 11,192,613 | B2 | 12/2021 | Grall | |
| 2018/0319469 | A1 * | 11/2018 | Roefaro | B63C 1/06 |

FOREIGN PATENT DOCUMENTS

| | | |
|---|---|---|
| WO | WO2016108310 | 7/2016 |

* cited by examiner

*Primary Examiner* — Kyle Armstrong

(57) ABSTRACT

An inflatable lift assembly for raising and supporting a boat over a body of water, without completely removing the boat from the body of water, includes a port-side inflatable floats connected to a starboard-side inflatable float by a plurality of cables. The inflatable floats each include an outer end opposite an inner end, a valve attached to the floats proximate the outer end and in fluid communication with an interior of each float, and an anchor tab where the plurality of cables couples the two floats together. The inflatable floats may be inflated by pumping compressed air into the interiors through the valves while the floats are placed under the boat, causing the floats to gently lift the boat slightly above the water. Embodiments may be sized according to the particular size of the boat being supported.

20 Claims, 8 Drawing Sheets

INFLATABLE LIFT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to inflatable lifts and more particularly pertains to a new inflatable lift assembly for raising and supporting a boat, watercraft, or other vessel over a body of water without completely removing the vessel from the body of water.

(2) Description of Related Art Including Information Disclosed Under 37 CFR 1.97 and 1.98

The prior art relates to boat docks and lifts. Generally, the prior art describes boat docks and lifts which completely remove the boat or other watercraft from the body of water. These docks and lifts are generally large, heavy, or bulky apparatuses which are immobile or very difficult to move from one body of water to another. Other docks and lifts in the prior art keep the hull or the outboard engine of the boat submerged under water, where aquatic growth and marine life may damage the hull or engine. Thus, there is a need in the prior art for a portable boat lift which can support a boat over a body of water, with the hull and onboard engine completely or mostly removed from the water.

BRIEF SUMMARY OF THE INVENTION

An embodiment of the disclosure meets the needs presented above by generally comprising an inflatable lift assembly for supporting a boat or other watercraft above a body of water. The inflatable lift assembly includes a port-side inflatable float connected to a starboard-side inflatable float by a plurality of cables. The port-side inflatable float has a port-side outer end opposite a port-side inner end. A port-side valve is attached to the port-side inflatable float and is in fluid communication with an interior of the port-side inflatable float. A port-side anchor tab is attached to and extends from the port-side outer end. The port-side anchor tab is configured to receive and connect with a port-side tie. The port-side tie is configured to removably attach the port-side anchor tab with the boat or other watercraft. The port-side inflatable float also has a port-side connecting tab attached to and extending outwardly from the port-side inner end. The port-side inflatable float has an elongated port-side body extending between the port-side outer end and the port-side inner end that is in fluid communication with the interior of the port-side inflatable float. The elongated port-side body is configured to expand a port-side width of the elongated port-side body when the interior of the port-side inflatable float is filled with air. For example, the port-side width may be minimized when the interior of the port-side inflatable float is emptied of compressed air and maximized when the interior of the port-side inflatable float is filled with compressed air. The starboard-side inflatable float has a form which is substantially similar to the port-side inflatable float. The port-side inflatable float and the starboard-side inflatable float are coupled together by a plurality of cables which are affixed to and extend between the port-side connecting tab and the starboard-side connecting tab.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
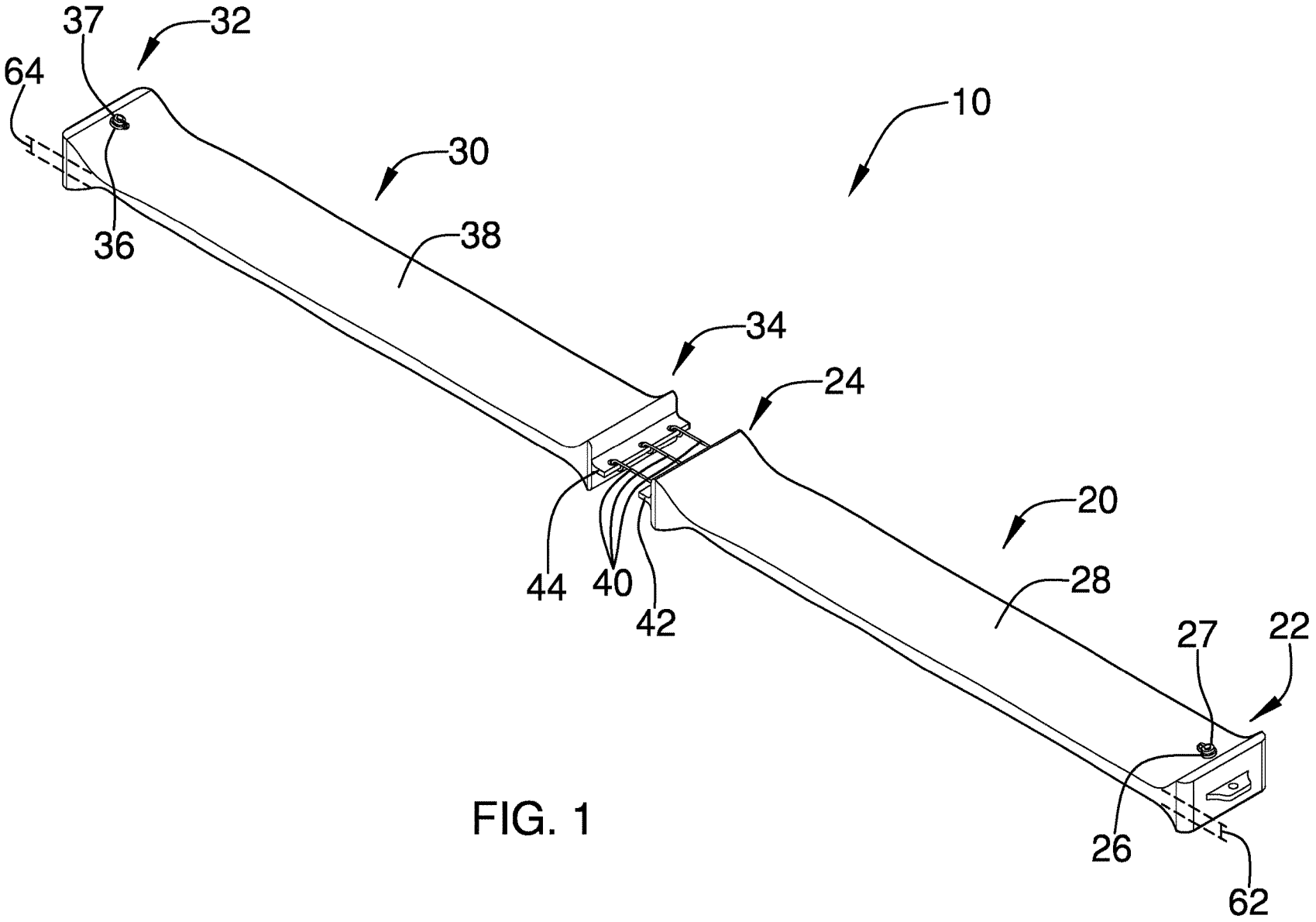
FIG. 1 is a front isometric projection view of an inflatable lift assembly according to an embodiment of the disclosure.

With reference now to the drawings, and in particular to FIGS. 1 through 9 thereof, a new inflatable lift embodying the principles and concepts of an embodiment of the disclosure and generally designated by the reference numeral 10 will be described.

As best illustrated in FIGS. 1 through 9, the inflatable lift assembly 10 generally comprises a port-side inflatable float 20 connected to a starboard-side inflatable 30 float by a plurality of cables 40.

The port-side inflatable float 20 has a port-side outer end 22 opposite a port-side inner end 24. A port-side valve 26 may be attached to the port-side inflatable float 20 in fluid communication with an interior of the port-side inflatable float 20. In certain embodiments, the port-side valve 26 is proximate to the port-side outer end 22 and is configured to receive a port-side compressed air line 72. A port-side valve cap 29 is tethered to the port-side valve 26 and is configured to form an air-tight seal over the port-side valve 26 when the port-side valve cap 29 is secured over the port-side valve 26. For example, the port-side valve cap 27 may screw or snap into place over the port-side valve 26 when the port-side compressed air line 72 is removed from the port-side valve 26.

A port-side anchor tab 52 is attached to and extends from the port-side outer end 22. The port-side anchor tab 52 is configured to receive and connect with a port-side tie 54. The port-side tie 54 is configured to removably attach the port-side anchor tab 42 with the boat 50. In specific embodiments, the port-side tie 54 generally comprises a durable and waterproof rope or cable capable of extending through the port-side anchor tab 52 and around a port-side boat cleat 55, firmly securing the port-side inflatable float 20 to the boat 50. In other embodiments, the port-side anchor tab 52 may be further configured to accept a plurality of port-side ties 54, for example enabling the port-side inflatable float 20 to be secured to both the boat 50 and a dock 80.

The port-side inflatable float 20 has an elongated port-side body 28 extending between the port-side outer end 22 and the port-side inner end 24. The elongated port-side body 28 is in fluid communication with the interior of the port-side inflatable float 20. In certain embodiments, the elongated port-side body 28 is generally rectangular and has a port-side length 29 of between 4 feet and 12 feet. Other embodiments include an elongated port-side body 28 that is generally cylindrical, or that has a port-side length 29 of between 1 foot and 4 feet. For example, an embodiment with a longer port-side length 29 may be appropriate for a larger boat 50 that has a wider beam, while an embodiment with a shorter port-side length 29 may be appropriate for a smaller boat 50 that has a shorter beam. Embodiments with a shorter port-side length 29 may also be more appropriately configured for use with other watercraft or vessels, such as jet skis.

The exact shape and length of the elongated port-side body 28 may vary, so long as the elongated port-side body 28 is configured to extend around approximately one-half of the hull of the boat 50 or other watercraft being supported by the inflatable lift assembly 10. More specifically, preferred embodiments include an elongated port-side body 28 with sufficient length to wrap around the hull of the boat 50 from a mid-point underneath the boat and up to a location proximate the port-side boat cleat 55. In these embodiments, shown in FIGS. 7 and 9, the port-side inflatable float 20 may both support the boat 50 and act as a buffer or buoy to prevent the boat 50 from colliding with the dock 80.

Figure 2:
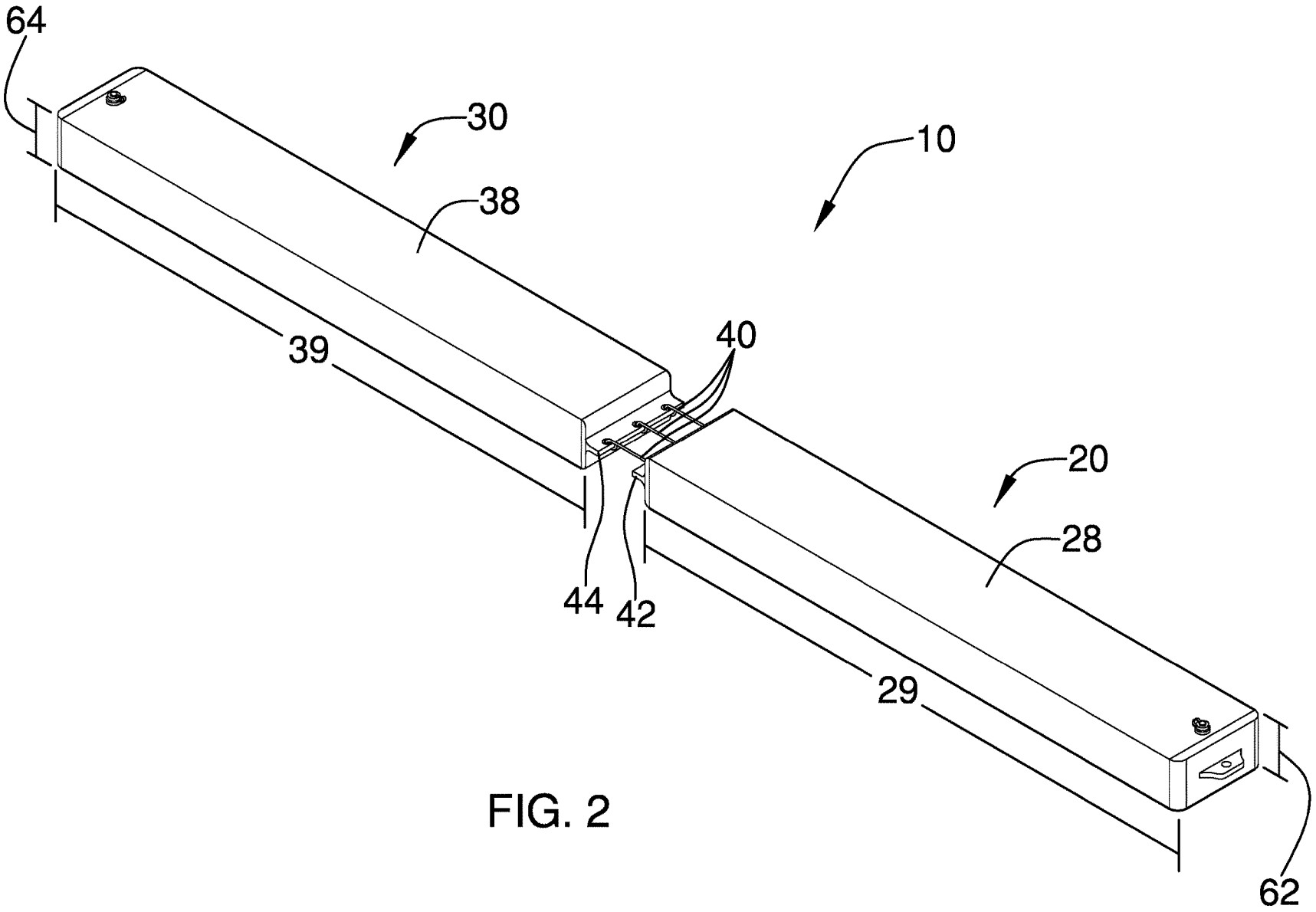
FIG. 2 is a front isometric projection view of an embodiment of the disclosure.

Embodiments of the inflatable lift assembly 10 may feature an elongated port-side body 28 that is formed from a durable and flexible waterproof port-side body material such as canvas or plastic. The elongated port-side body 28 may be configured to expand a port-side width 62 of the elongated port-side body 28 when the interior of the port-side inflatable float 20 is filled with air. In exemplary embodiments such as those shown in FIGS. 6 and 7, the air may be fed into the interior of the port-side inflatable float 20 through the port-side compressed air line 72. For example, the port-side width 62 may be minimized when the interior of the port-side inflatable float 20 is emptied of compressed air, as shown in FIG. 1. As an alternative example, the port-side width 62 may be maximized when the interior of the port-side inflatable float 20 is filled with compressed air, as shown in FIG. 2.

A port-side connecting tab 42 is attached to and extends outwardly from the port-side inner end 24. In embodiments, the port-side connecting tab 42 generally extends from the port-side inner end 24 toward a starboard-side inner end 34.

The starboard-side inflatable float 30 generally has a starboard-side outer end 32 opposite the starboard-side inner end 34. A starboard-side valve 36 may be attached to the starboard-side inflatable float 30 in fluid communication with an interior of the starboard-side inflatable float 30. In certain embodiments, the starboard-side valve 36 is proximate the starboard-side outer end 32 and configured to receive a starboard-side compressed air line 74. A starboard-side valve cap 37 may be tethered to the starboard-side valve 36 and configured to form an air-tight seal over the starboard-side valve 36 when the starboard-side valve cap 37 is secured on the starboard-side valve 36. For example, the starboard-side valve cap 37 may screw or snap into place over the starboard-side valve 36 when the starboard-side compressed air line 74 is removed from the starboard-side valve 36.

A starboard-side anchor tab 56 is attached to and extends outwardly from the starboard-side outer end 32. The starboard-side anchor tab 56 is configured to receive a starboard-side tie 58. The starboard-side tie 58 is configured to removably attach the starboard-side anchor tab 56 with the boat 50. In specific embodiments, the starboard-side tie 58 generally comprises a durable and waterproof rope or cable capable of extending through the starboard-side anchor tab 56 and around a starboard-side boat cleat 59, firmly securing the starboard-side inflatable float 30 to the boat 50. In other embodiments, the starboard-side anchor tab 56 may be further configured to accept a plurality of starboard-side ties 58, for example enabling the starboard-side inflatable float 30 to be secured to both the boat 50 and a dock 80.

The starboard-side inflatable float 30 further includes a starboard-side connecting tab 44 that is attached to and extends outwardly from the starboard-side inner end 34. In embodiments, the starboard-side connecting tab 44 generally extends from the starboard-side inner end 34 toward the port-side connecting tab 42 connected to the port-side inner end 24.

Embodiments of the starboard-side inflatable float 30 have an elongated starboard-side body 38 extending between the starboard-side outer end 32 and the starboard side inner end 34. The elongated starboard-side body 38 is in fluid communication with the interior of the starboard-side inflatable float 30. Certain embodiments of the elongated starboard-side body 38 may be generally rectangular.

Other embodiments of the elongated starboard-side body 38 may be generally cylindrical. Preferred embodiments will include an elongated starboard-side body 38 having dimensions approximately equivalent to the dimensions of the elongated port-side body 28. For example, if the port-side length 29 is 6 feet, then preferred embodiments will include a starboard-side body 38 having a starboard-side length 39 of 6 feet. In such embodiments, the port-side width 62 may also be approximately equivalent to the starboard-side width 64.

Other exemplary embodiments may include an elongated starboard-side body 38 that is generally cylindrical, or that has a starboard-side length 39 of between 1 foot and 4 feet. For example, an embodiment with a longer starboard-side length 39 may be appropriate for a larger boat 50 that has a wider beam, while an embodiment with a shorter starboard-side length 39 may be appropriate for a smaller boat 50 that has a shorter beam. Embodiments with a shorter starboard-side length 39 may also be more appropriately configured for use with other watercraft or vessels, such as jet skis.

The exact geometric shape and length of the elongated starboard-side body 38 may vary, so long as the elongated starboard-side body 38 is configured to extend around approximately one-half of the hull of the boat 50 or other watercraft being supported by the inflatable lift assembly 10. More specifically, preferred embodiments include an elongated starboard-side body 38 with sufficient length to wrap around the hull of the boat 50 from a mid-point underneath the boat and up to a location proximate the starboard-side boat cleat 59. In these embodiments, shown in FIGS. 7 and 9, the starboard-side inflatable float 30 may both support the boat 50 and act as a buffer or buoy to prevent the boat 50 from colliding with the dock 80.

Embodiments of the inflatable lift assembly 10 may feature an elongated starboard-side body 38 that is formed from a durable and flexible waterproof starboard-side body material such as canvas or plastic. The elongated starboard-side body 38 is configured to expand a starboard-side width 64 of the elongated starboard-side body 38 when the interior of the starboard-side inflatable float 30 is filled with air. In exemplary embodiments such as those shown in FIGS. 6 and 7, the air may be fed into the interior of the starboard-side inflatable float 30 through the starboard-side compressed air line 74. For example, the starboard-side width 64 may be minimized when the interior of the starboard-side inflatable float 30 is emptied of compressed air, as shown in FIG. 1. As an alternative example, the starboard-side width 64 may be maximized when the interior of the starboard-side inflatable float 30 is filled with compressed air, as shown in FIG. 2.

A plurality of connecting cables 40 couples the port-side inflatable float 20 to the starboard-side inflatable float 30. The plurality of connecting cables 40 is affixed to and extends between the port-side connecting tab 42 and the starboard-side connecting tab 44, as shown most clearly in FIGS. 1, 2, 4, and 5. In certain embodiments, the plurality of connecting cables 40 is 1 foot to 2 feet in length. In alternative embodiments, the plurality of connecting cables 40 may be longer or shorter, so long as the plurality of connecting cables 40 is configured to provide a strong, flexible connection between the port-side inflatable float 20 and the starboard-side inflatable float 30. In some embodiments, the plurality of connecting cables 40 may have an adjustable length so that the inflatable lift assembly 10 may be used for a variety of differently sized watercraft. Because the plurality of connecting cables 40 may remain at least partially submerged while the inflatable lift assembly 10 is in use, it is important that the plurality of connecting cables 40 be formed of a waterproof cable material that is durable enough to withstand extended periods of submersion under water without weakening or disintegrating. For example, the waterproof cable material may be nylon, canvas, plastic, or some combination thereof.

Figure 3:
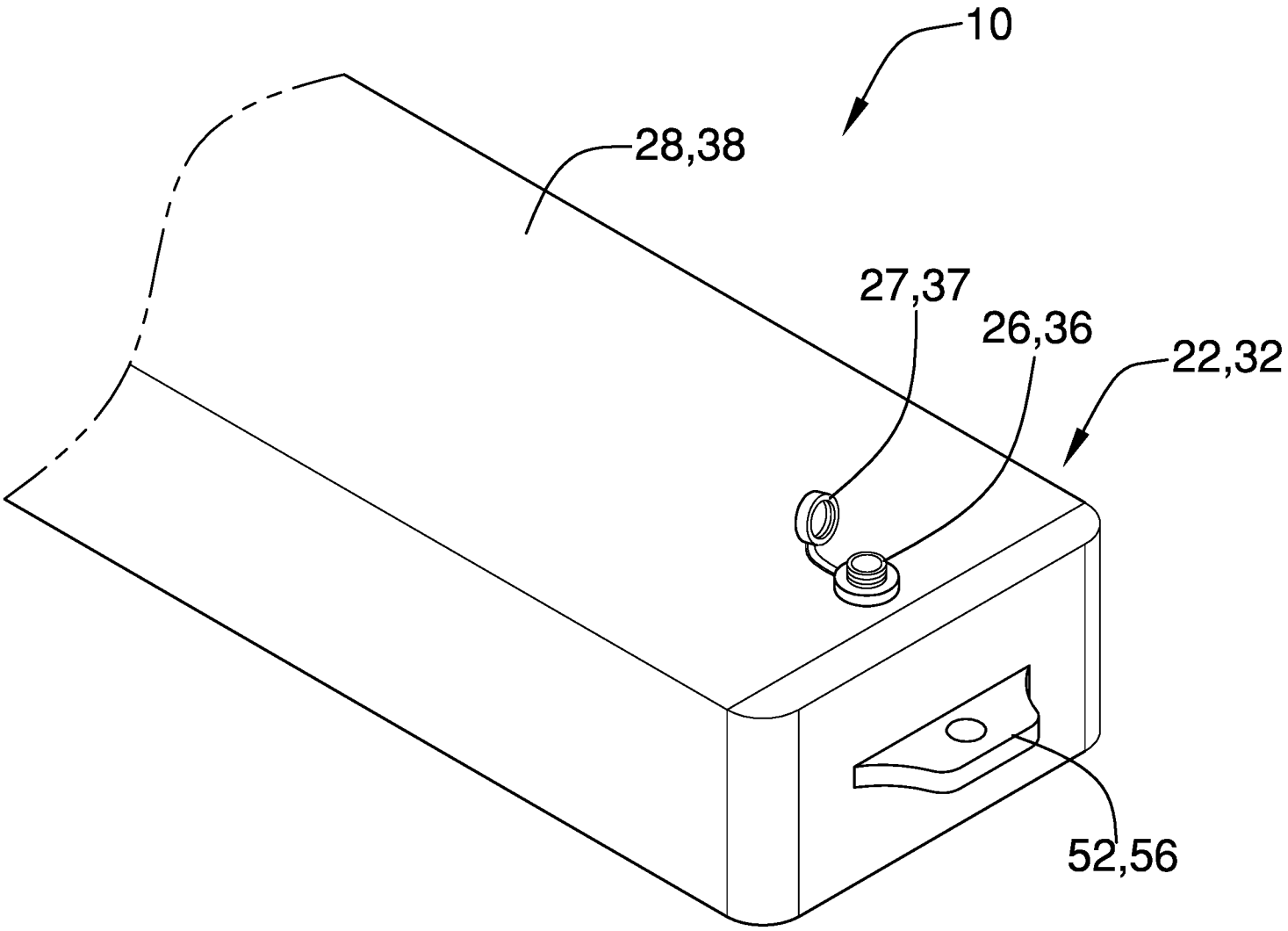
FIG. 3 is a partial, detailed isometric projection view of an embodiment of the disclosure.
Figure 4:
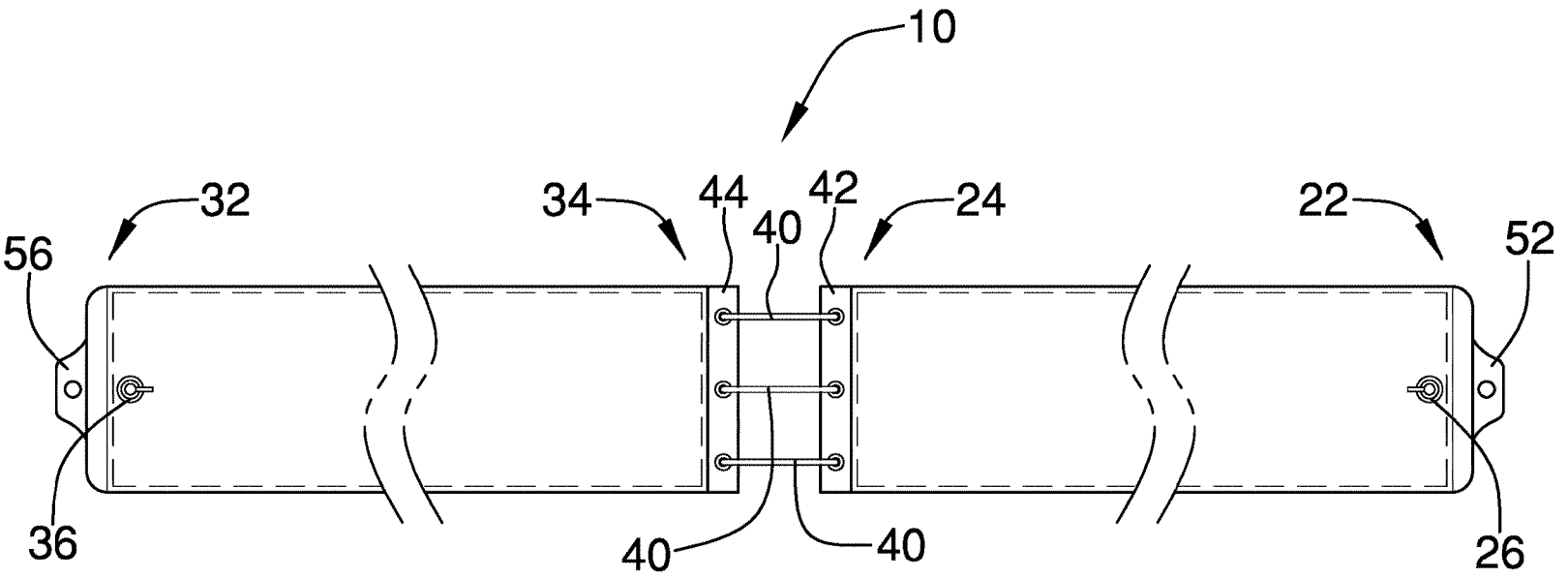
FIG. 4 is a partial top view of an embodiment of the disclosure.
Figure 5:
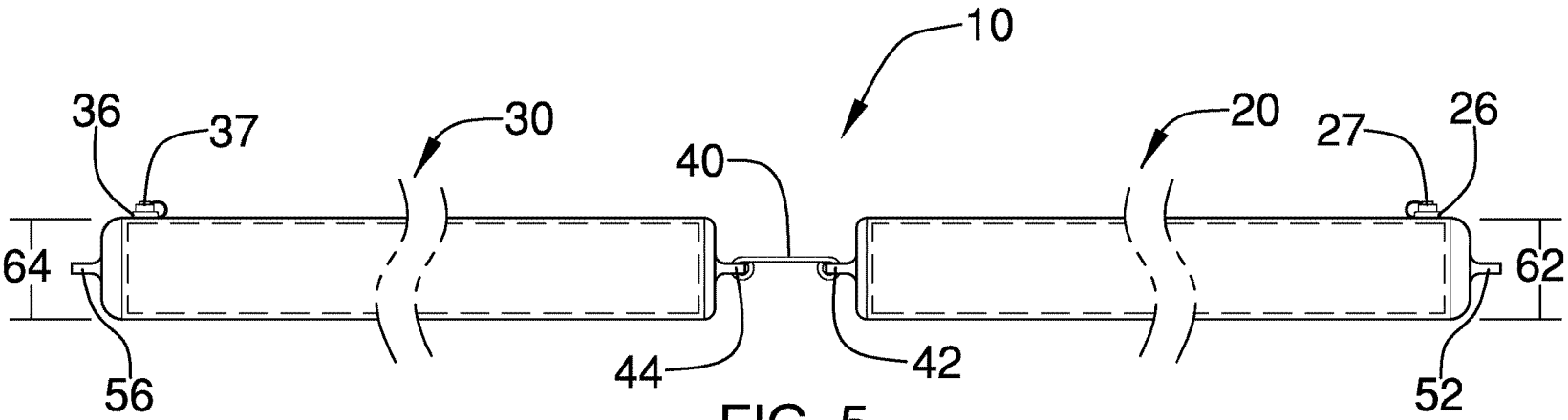
FIG. 5 is a partial side view of an embodiment of the disclosure.

As shown in FIGS. 1-5, the port-side inflatable float 20 and the starboard-side inflatable float 30 have very similar structures. FIG. 1 shows an isometric view of the inflatable lift assembly 10 when the port-side inflatable float 20 and the starboard-side inflatable float 30 are deflated. FIG. 2 shows an isometric view of the inflatable lift assembly 10 when the port-side inflatable float 20 and the starboard-side inflatable float 30 are inflated. FIG. 3 shows a partial view of an inflated port-side outer end 22 or an inflated starboard-side outer end 22. FIGS. 4 and 5 provide partial top and side views of the inflatable lift assembly 10 and include depictions of the outer ends 22, 32, the inner ends 24, 34, and the plurality of connecting cables 40.

In use, the inflatable lift assembly 10 also provides a method for lifting and supporting the boat 50 above the body of water 60 near a dock 80, as shown in FIGS. 6-9. In general, embodiments of the present invention may be useful when the boat 50 has a port-side boat cleat 55 and a starboard-side boat cleat 59. However, neither the port-side boat cleat 55 nor the starboard-side boat cleat 59 are strictly necessary, as long as the boat 50 includes some feature capable of being tied securely to the port-side anchor tab 52 and the starboard-side anchor tab 56.

Figure 6:
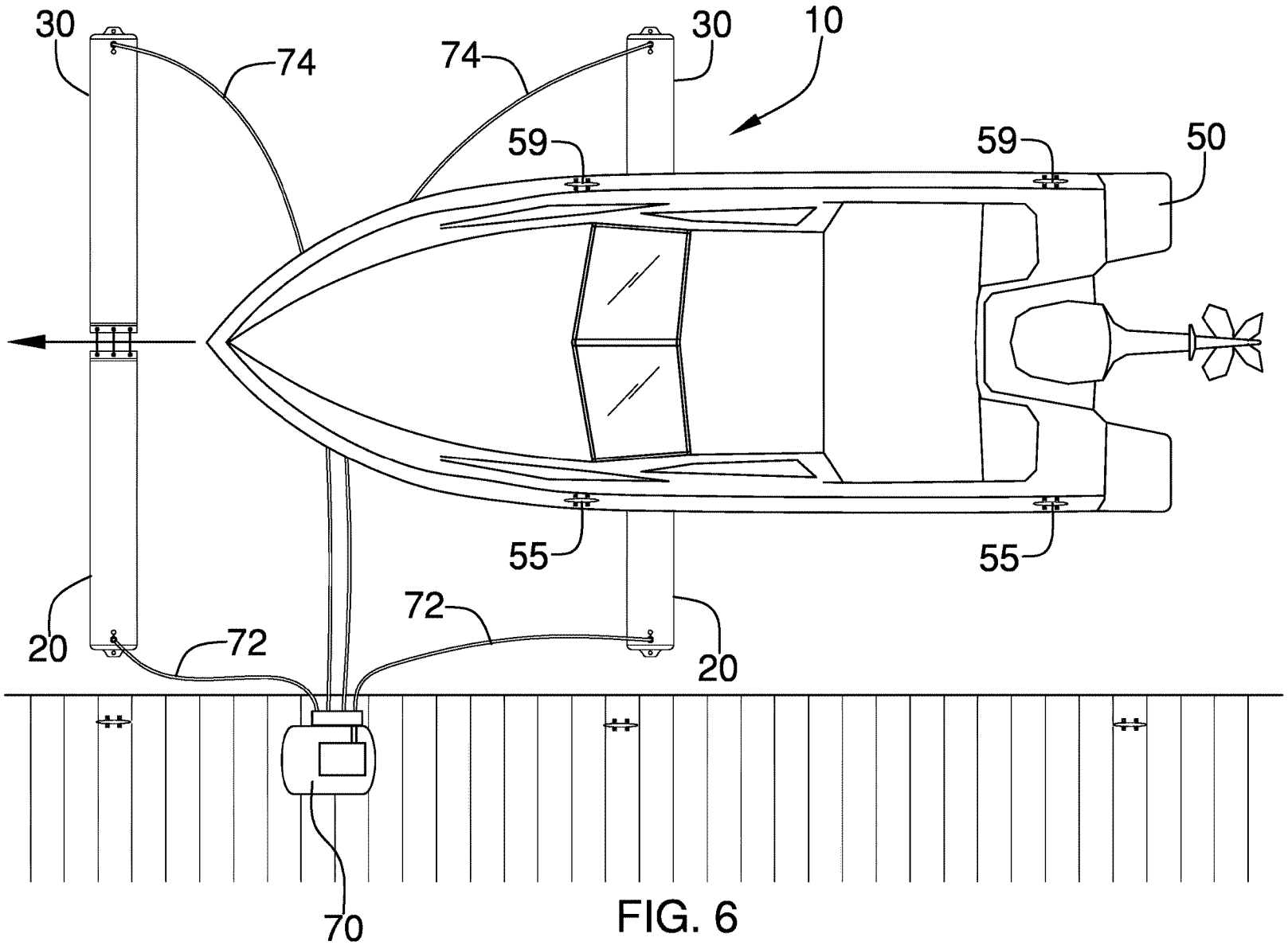
FIG. 6 is an in-use top view of an embodiment of the disclosure.
Figure 7:
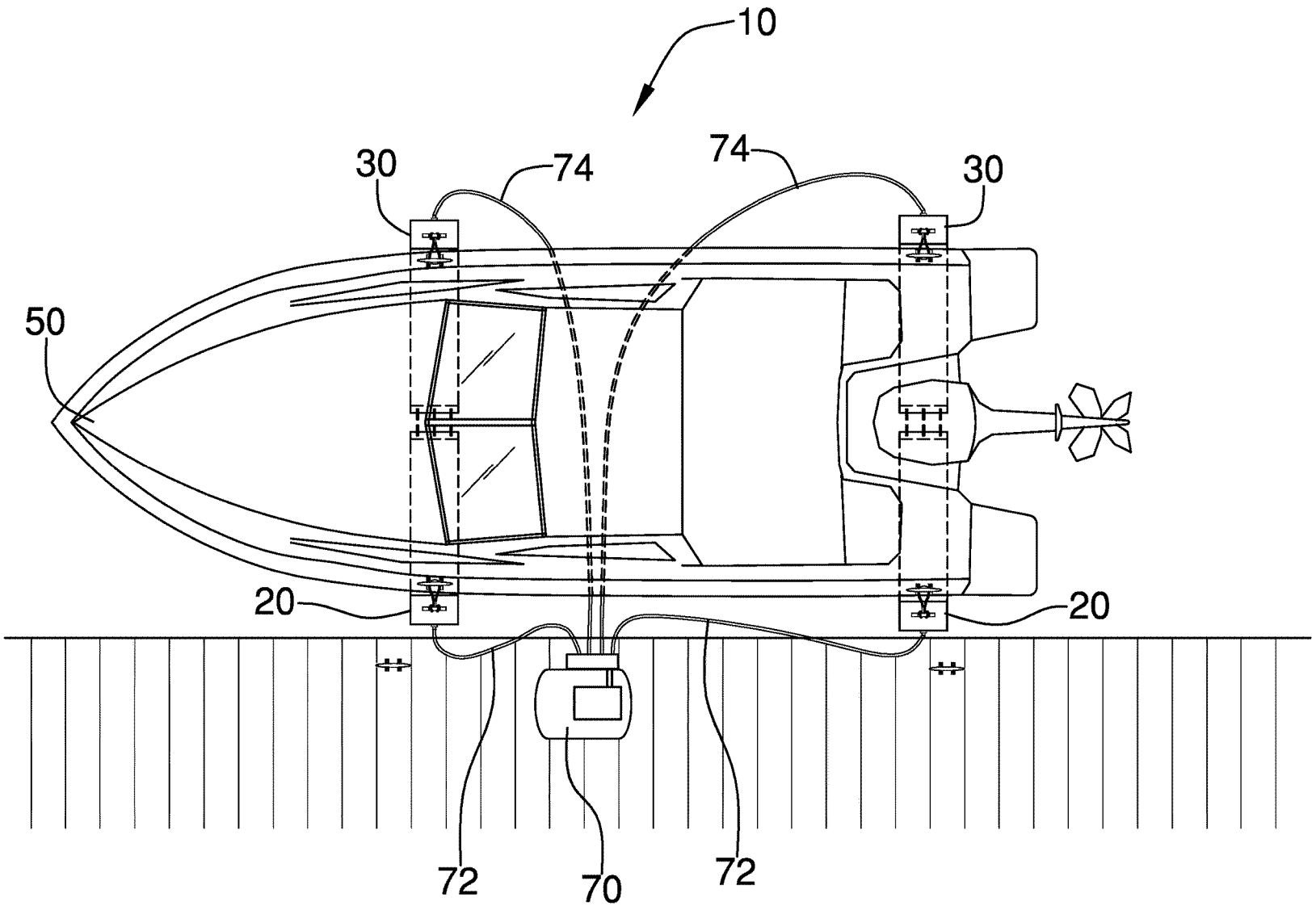
FIG. 7 is an in-use top view of an embodiment of the disclosure.
Figure 8:
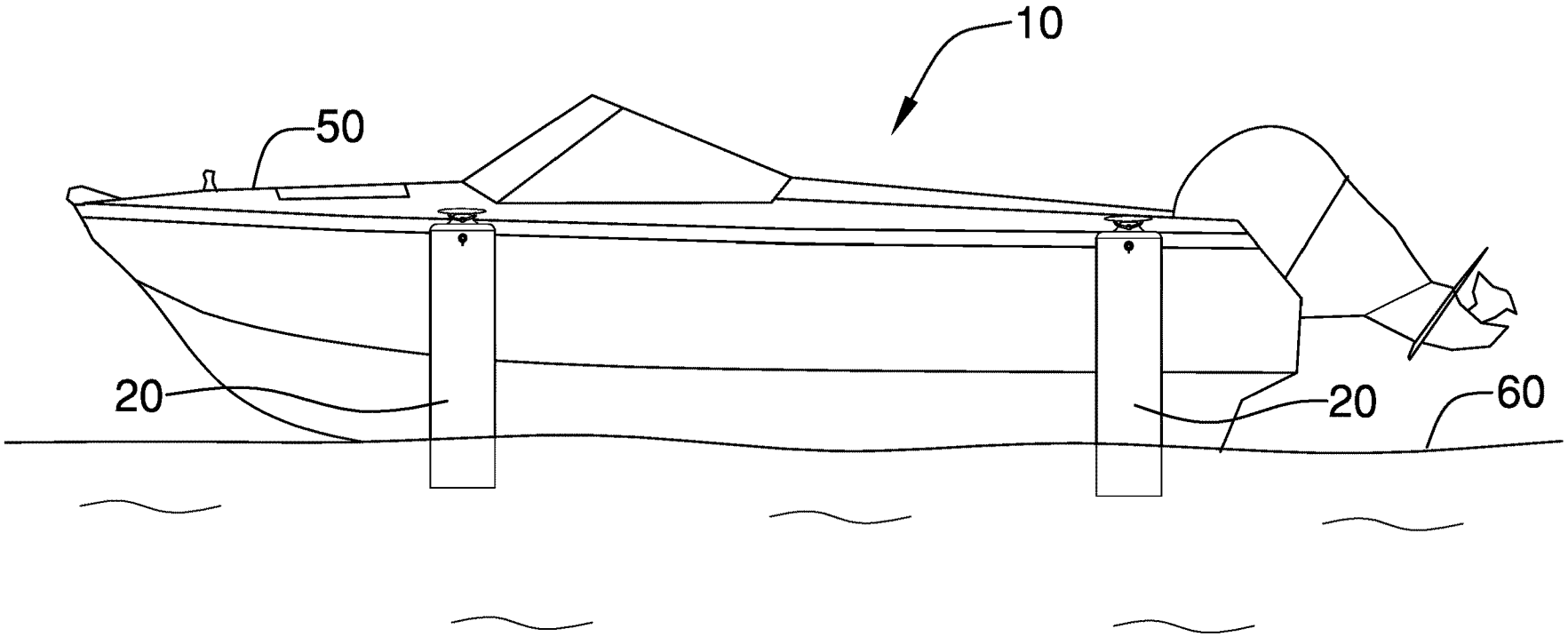
FIG. 8 is an in-use side view of an embodiment of the disclosure.
Figure 9:
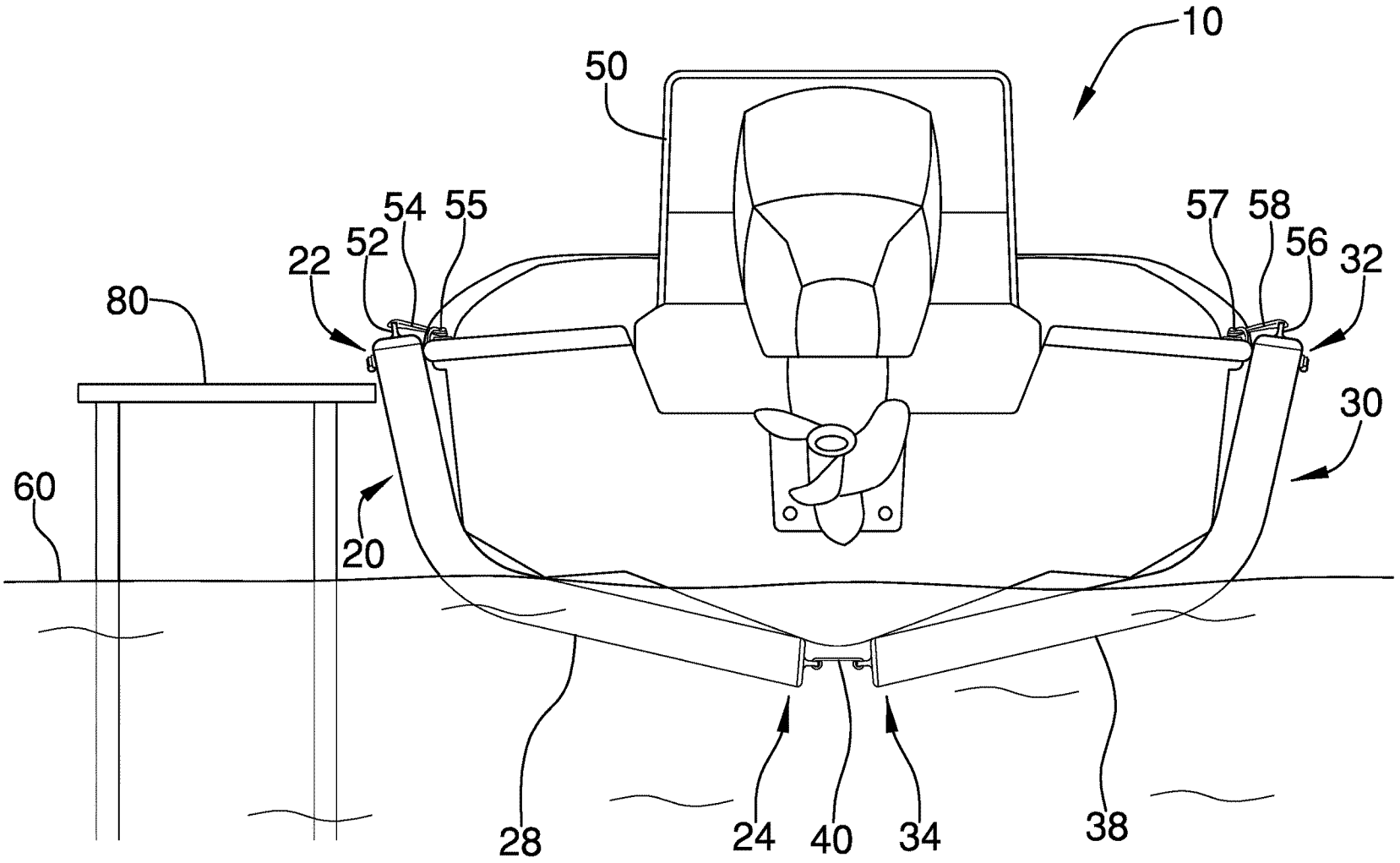
FIG. 9 is an in-use rear view of an embodiment of the disclosure.

A specific embodiment of the method contemplated by this invention comprises placing the inflatable lift assembly 10 into the body of water 60 near the dock 80, as shown in FIG. 6. In the exemplary embodiment described by FIGS. 6-8, two inflatable lift assemblies 10 are placed approximately parallel with one another in the body of water 60. Please note that, in other embodiments, a single inflatable lift assembly 10 may be used, as shown in FIG. 9. An air pump 70, or an air compressor, may be connected to the inflatable lift assembly 10 by attaching the port-side compressed air line 72 with the port-side valve 26 and attaching the starboard-side compressed air line 74 with the starboard-side valve 36. If two parallel inflatable lift assemblies 10 are being used, as shown in FIGS. 6-8, all valves 26, 36 should be connected with the corresponding compressed air lines 72, 74.

Once the compressed air lines are connected with the valves, the boat can be driven forward (in the direction of the arrow shown on FIG. 6) and placed directly over the inflatable lift assembly 10. In general, the port-side boat cleat 55 should align with the port-side anchor tab 52 and the starboard-side boat cleat 59 should align with the starboard-side anchor tab 56.

Once the boat 50 is aligned with the inflatable lift assembly 10, the port-side outer end 22 may be lifted from the body of water 60, raising the port-side anchor tab 52 to be proximate with the port-side boat cleat 55. The port-side tie 54 can then be engaged to secure the port-side anchor tab 52 with the port-side boat cleat 55. Similarly, the starboard-side anchor tab 56 may be lifted from the body of water 60 and raised proximate to the starboard-side boat cleat 59. The starboard-side tie 58 can then be engaged to secure the starboard-side anchor tab 56 with the starboard-side boat cleat 59. FIG. 7 shows an exemplary embodiment of the present invention once the anchor tabs 52, 56 are secured to the boat cleats 55, 59.

Using the air pump, compressed air can then be fed into the interiors of the port-side inflatable float 20 and the starboard-side inflatable float 30. Once the port-side inflatable float 20 and the starboard-side inflatable float 30 are fully inflated, for example when the port-side width 62 and the starboard-side width 64 are maximized, the compressed air lines 72, 74 may be disconnected from the valves 26, 36. As shown in FIG. 8, the port-side valve 26 and the starboard-side valve 36 should be within arm's reach from inside the boat 50 so that the compressed air lines 72, 74 may be easily disconnected. Securing the port-side anchor tab 52 with the port-side boat cleat 55 and the starboard-side anchor tab 56 with the starboard-side boat cleat 59 helps ensure the valves 26, 36 are within easy reach. The port-side valve cap 27 may then be secured over the port-side valve 26 and the starboard-side valve cap 37 may be secured over the starboard-side valve 36.

To the boat 50 from the inflatable lift assembly 10, the port-side valve cap 27 can be removed from the port-side valve 26 and the starboard-side valve cap 37 may be removed from the starboard-side valve 36. Then, the port-side compressed air line 72 may be reconnected with the port-side valve 26 and the starboard-side compressed air line 74 may be reconnected with the starboard-side valve 36. The air pump can be turned on in reverse, to suck the compressed air out of the interiors of the port-side inflatable float 20 and the starboard-side inflatable float 30. In alternative embodiments, the port-side valve 26 and the starboard-side valve 36 may be configured to release air passively whenever the port-side valve cap 27 and the starboard-side valve cap 37 are removed from their respective valves 26, 36. Once the inflatable floats 20, 30 are deflated, the boat will be placed back into the body of water 60 and can be driven off of the inflatable lift assembly 10. The inflatable lift assembly 10 can then be removed from the body of water 60 and stored for later use. Because the components of the inflatable lift assembly 10 are generally formed of pliable materials, the inflatable lift assembly 10 can be rolled, folded, or otherwise stored in a convenient and efficient manner.

One aspect of the present disclosure is an inflatable lift assembly for supporting a boat, said inflatable lift assembly comprising: a port-side inflatable float having a port-side outer end opposite a port-side inner end, a port-side valve being attached to said port-side inflatable float and in fluid communication with an interior of said port-side inflatable float, said port-side valve being proximate said port-side outer end and configured to receive a port-side compressed air line, a port-side valve cap tethered to said port-side valve and configured to form an air-tight seal over said port-side valve when said port-side valve cap is secured over said port-side valve, a port-side anchor tab being attached to and extending from said port-side outer end, said port-side anchor tab being configured to receive and connect with a port-side tie, said port-side tie being configured to removably attach said port-side anchor tab with said boat, and a port-side connecting tab being attached to and extending outwardly from said port-side inner end, wherein said port-side inflatable float has an elongated port-side body extending between said port-side outer end and said port-side inner end and being in fluid communication with said interior of said port-side inflatable float, said elongated port-side body being generally rectangular with a port-side length of between 4 feet and 12 feet and being formed from a durable and flexible waterproof port-side body material configured to expand a port-side width of said elongated port-side body when said interior of said port-side inflatable float is filled with air through said port-side compressed air line, said port-side width being minimized when said interior of said port-side inflatable float is emptied of compressed air and being maximized when said interior of said port-side inflatable float is filled with compressed air, said compressed air being pumped into and out of said interior of said port-side inflatable float via said port-side compressed air line when said port-side compressed air line is in fluid communication with said port-side valve while said port-side valve cap is removed from said port-side valve; a starboard-side inflatable float having a starboard-side outer end opposite a starboard-side inner end, a starboard-side valve being attached to said starboard-side inflatable float and in fluid communication with an interior of said starboard-side inflatable float, said starboard-side valve being proximate said starboard-side outer end and configured to receive a starboard-side compressed air line, a starboard-side valve cap tethered to said starboard-side valve and configured to form an air-tight seal over said starboard-side valve when said starboard-side valve cap is secured on said starboard-side valve, a starboard-side anchor tab being attached to and extending outwardly from said starboard-side outer end, said starboard-side anchor tab being configured to receive a starboard-side tie, said starboard-side tie being configured to removably attach said starboard-side anchor tab with said boat, and a starboard-side connecting tab being attached to and extending outwardly from said starboard-side inner end, wherein said starboard-side inflatable float has an elongated starboard-side body extending between said starboard-side outer end and said starboard side inner end and being in fluid communication with said interior of said starboard-side inflatable float, said elongated starboard-side body being generally rectangular with a starboard-side length approximately equivalent to said port-side length, said elongated starboard-side body being formed from a durable and flexible waterproof starboard-side body material configured to expand a starboard-side width of said elongated starboard-side body when said interior of said starboard-side inflatable float is filled with air through said starboard-side compressed air line, said starboard-side width being minimized when said interior of said starboard-side inflatable float is emptied of compressed air and being maximized when said interior of said starboard-side inflatable float is filled with compressed air, said compressed air being pumped into and out of said interior of said starboard-side inflatable float via said starboard-side compressed air line when said starboard-side compressed air line is in fluid communication with said starboard-side valve while said starboard-side valve cap is removed from said starboard-side valve; and a plurality of connecting cables coupling said port-side inflatable float to said starboard-side inflatable float, said plurality of connecting cables being affixed to and extending between said port-side connecting tab and said starboard-side connecting tab, said plurality of connecting cables being 1 foot to 2 feet in length and formed of a waterproof cable material, said waterproof cable material being durable enough to withstand extended periods of submersion underwater without weakening or disintegrating.

A second aspect of the present disclosure is a method for lifting a boat with a port-side boat cleat and a starboard-side boat cleat above a body of water at a docking site and supporting said boat above said body of water at said docking site, said method comprising: placing an inflatable lift assembly into said body of water at said docking site, said inflatable lift assembly comprising, a port-side inflatable float having a port-side outer end opposite a port-side inner end, a port-side valve being attached to said port-side inflatable float and in fluid communication with an interior of said port-side inflatable float, said port-side valve being proximate said port-side outer end and configured to receive a port-side compressed air line, a port-side valve cap tethered to said port-side valve and configured to form an air-tight seal over said port-side valve when said port-side valve cap is secured over said port-side valve, a port-side anchor tab being attached to and extending from said port-side outer end, said port-side anchor tab being configured to receive and connect with a port-side tie, said port-side tie being configured to removably attach said port-side anchor tab with said boat, and a port-side connecting tab being attached to and extending outwardly from said port-side inner end, wherein said port-side inflatable float has an elongated port-side body extending between said port-side outer end and said port-side inner end and being in fluid communication with said interior of said port-side inflatable float, said elongated port-side body being generally rectangular with a port-side length of between 4 feet and 12 feet and being formed from a durable and flexible waterproof port-side body material configured to expand a port-side width of said elongated port-side body when said interior of said port-side inflatable float is filled with air through said port-side compressed air line, said port-side width being minimized when said interior of said port-side inflatable float is emptied of compressed air and being maximized when said interior of said port-side inflatable float is filled with compressed air, said compressed air being pumped into and out of said interior of said port-side inflatable float via said port-side compressed air line when said port-side compressed air line is in fluid communication with said port-side valve while said port-side valve cap is removed from said port-side valve; a starboard-side inflatable float having a starboard-side outer end opposite a starboard-side inner end, a starboard-side valve being attached to said starboard-side inflatable float and in fluid communication with an interior of said starboard-side inflatable float, said starboard-side valve being proximate said starboard-side outer end and configured to receive a starboard-side compressed air line, a starboard-side valve cap tethered to said starboard-side valve and configured to form an air-tight seal over said starboard-side valve when said starboard-side valve cap is secured on said starboard-side valve, a starboard-side anchor tab being attached to and extending outwardly from said starboard-side outer end, said starboard-side anchor tab being configured to receive a starboard-side tie, said starboard-side tie being configured to removably attach said starboard-side anchor tab with said boat, and a starboard-side connecting tab being attached to and extending outwardly from said starboard-side inner end, wherein said starboard-side inflatable float has an elongated starboard-side body extending between said starboard-side outer end and said starboard side inner end and being in fluid communication with said interior of said starboard-side inflatable float, said elongated starboard-side body being generally rectangular with a starboard-side length approximately equivalent to said port-side length, said elongated starboard-side body being formed from a durable and flexible waterproof starboard-side body material configured to expand a starboard-side width of said elongated starboard-side body when said interior of said starboard-side inflatable float is filled with air through said starboard-side compressed air line, said starboard-side width being minimized when said interior of said starboard-side inflatable float is emptied of compressed air and being maximized when said interior of said starboard-side inflatable float is filled with compressed air, said compressed air being pumped into and out of said interior of said starboard-side inflatable float via said starboard-side compressed air line when said starboard-side compressed air line is in fluid communication with said starboard-side valve while said starboard-side valve cap is removed from said starboard-side valve; a plurality of connecting cables coupling said port-side inflatable float to said starboard-side inflatable float, said plurality of connecting cables being affixed to and extending between said port-side connecting tab and said starboard-side connecting tab, said plurality of connecting cables being 1 foot to 2 feet in length and formed of a waterproof cable material, said waterproof cable material being durable enough to withstand extended periods of submersion underwater without weakening or disintegrating; connecting an air pump to said port-side valve and to said starboard-side valve via said port-side compressed air line and said starboard-side compressed air line; placing said boat directly over said inflatable lift assembly, said port-side boat cleat being generally aligned with said port-side anchor tab and said starboard-side boat cleat being generally aligned with said starboard-side anchor tab; lifting said port-side outer end and said starboard-side outer end to raise and align said port-side anchor tab and said starboard-side anchor tab with said port-side boat cleat and said starboard-side boat cleat; securing said port-side anchor tab to said port-side boat cleat using said port-side tic; securing said starboard-side anchor tab to said starboard-side boat cleat using said starboard-side tie; inflating said port-side inflatable float and said starboard-side inflatable float using said air pump to fill said interior of said port-side inflatable float with compressed air and to fill said interior of said starboard-side inflatable float with compressed air; disconnecting said port-side compressed air line from said port-side valve; securing said port-side valve cap onto said port-side valve; disconnecting said starboard-side compressed air line from said starboard-side valve; and securing said starboard-side valve cap onto said starboard-side valve.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An inflatable lift assembly for supporting a boat, said inflatable lift assembly comprising:

a port-side inflatable float having a port-side outer end opposite a port-side inner end, a port-side valve being attached to said port-side inflatable float and in fluid communication with an interior of said port-side inflatable float, a port-side anchor tab being attached to and extending from said port-side outer end, said port-side anchor tab being configured to receive and connect with a port-side tie, said port-side tie being configured to removably attach said port-side anchor tab with said boat, and a port-side connecting tab being attached to and extending outwardly from said port-side inner end, wherein said port-side inflatable float has an elongated port-side body extending between said port-side outer end and said port-side inner end and being in fluid communication with said interior of said port-side inflatable float, said elongated port-side body being configured to expand a port-side width of said elongated port-side body when said interior of said port-side inflatable float is filled with air, said port-side width being minimized when said interior of said port-side inflatable float is emptied of compressed air and being maximized when said interior of said port-side inflatable float is filled with compressed air;

a starboard-side inflatable float having a starboard-side outer end opposite a starboard-side inner end, a starboard-side valve being attached to said starboard-side inflatable float and in fluid communication with an interior of said starboard-side inflatable float, a starboard-side anchor tab being attached to and extending outwardly from said starboard-side outer end, said starboard-side anchor tab being configured to receive a starboard-side tie, said starboard-side tie being configured to removably attach said starboard-side anchor tab with said boat, and a starboard-side connecting tab being attached to and extending outwardly from said starboard-side inner end, wherein said starboard-side inflatable float has an elongated starboard-side body extending between said starboard-side outer end and said starboard side inner end and being in fluid communication with said interior of said starboard-side inflatable float, said elongated starboard-side body being configured to expand a starboard-side width of said elongated starboard-side body when said interior of said starboard-side inflatable float is filled with air, said starboard-side width being minimized when said interior of said starboard-side inflatable float is emptied of compressed air and being maximized when said interior of said starboard-side inflatable float is filled with compressed air; and a plurality of connecting cables coupling said port-side inflatable float to said starboard-side inflatable float, said plurality of connecting cables being affixed to and extending between said port-side connecting tab and said starboard-side connecting tab.

2. The inflatable lift assembly of claim 1, wherein said port-side valve is proximate said port-side outer end.

3. The inflatable lift assembly of claim 1, further comprising:

a port-side valve cap tethered to said port-side valve and configured to form an air-tight seal over said port-side valve when said port-side valve cap is secured over said port-side valve; and a starboard-side valve cap tethered to said starboard-side valve and configured to form an air-tight seal over said starboard-side valve when said starboard-side valve cap is secured on said starboard-side valve.

4. The inflatable lift assembly of claim 1, wherein said elongated port-side body is generally rectangular.

5. The inflatable lift assembly of claim 1, said elongated port-side body further comprising a port-side length of between 4 feet and 12 feet.

6. The inflatable lift assembly of claim 1, said elongated port-side body further comprising a port-side length of between 1 foot and 4 feet.

7. The inflatable lift assembly of claim 1, wherein said elongated port-side body is formed from a durable and flexible waterproof port-side body material such as canvas, plastic, or some combination thereof.

8. The inflatable lift assembly of claim 1, wherein said starboard-side valve is proximate said starboard-side outer end.

9. The inflatable lift assembly of claim 1, wherein said elongated starboard-side body is generally rectangular.

10. The inflatable lift assembly of claim 1, said elongated starboard-side body further comprising a starboard-side length of between 4 feet and 12 feet.

11. The inflatable lift assembly of claim 1, said elongated starboard-side body further comprising a starboard-side length of between 1 foot and 4 feet.

12. The inflatable lift assembly of claim 1, wherein said elongated starboard-side body is formed from a durable and flexible waterproof starboard-side body material such as canvas, plastic, or some combination thereof.

13. The inflatable lift assembly of claim 1, wherein said plurality of connecting cables is between 1 foot and 2 feet in length.

14. The inflatable lift assembly of claim 1, wherein the plurality of connecting cables have an adjustable length.

15. The inflatable lift assembly of claim 1, wherein said plurality of connecting cables is formed of a waterproof cable material, said waterproof cable material being durable enough to withstand extended periods of submersion underwater without weakening or disintegrating.

16. An inflatable lift assembly for supporting a boat, said inflatable lift assembly comprising:

a port-side inflatable float having a port-side outer end opposite a port-side inner end, a port-side valve being attached to said port-side inflatable float and in fluid communication with an interior of said port-side inflatable float, said port-side valve being proximate said port-side outer end and configured to receive a port-side compressed air line, a port-side valve cap tethered to said port-side valve and configured to form an air-tight seal over said port-side valve when said port-side valve cap is secured over said port-side valve, a port-side anchor tab being attached to and extending from said port-side outer end, said port-side anchor tab being configured to receive and connect with a port-side tie, said port-side tie being configured to removably attach said port-side anchor tab with said boat, and a port-side connecting tab being attached to and extending outwardly from said port-side inner end, wherein said port-side inflatable float has an elongated port-side body extending between said port-side outer end and said port-side inner end and being in fluid communication with said interior of said port-side inflatable float, said elongated port-side body being generally rectangular with a port-side length of between 4 feet and 12 feet and being formed from a durable and flexible waterproof port-side body material configured to expand a port-side width of said elongated port-side body when said interior of said port-side inflatable float is filled with air through said port-side compressed air line, said port-side width being minimized when said interior of said port-side inflatable float is emptied of compressed air and being maximized when said interior of said port-side inflatable float is filled with compressed air, said compressed air being pumped into and out of said interior of said port-side inflatable float via said port-side compressed air line when said port-side compressed air line is in fluid communication with said port-side valve while said port-side valve cap is removed from said port-side valve;

a starboard-side inflatable float having a starboard-side outer end opposite a starboard-side inner end, a starboard-side valve being attached to said starboard-side inflatable float and in fluid communication with an interior of said starboard-side inflatable float, said starboard-side valve being proximate said starboard-side outer end and configured to receive a starboard-side compressed air line, a starboard-side valve cap tethered to said starboard-side valve and configured to form an air-tight seal over said starboard-side valve when said starboard-side valve cap is secured on said starboard-side valve, a starboard-side anchor tab being attached to and extending outwardly from said starboard-side outer end, said starboard-side anchor tab being configured to receive a starboard-side tie, said starboard-side tie being configured to removably attach said starboard-side anchor tab with said boat, and a starboard-side connecting tab being attached to and extending outwardly from said starboard-side inner end, wherein said starboard-side inflatable float has an elongated starboard-side body extending between said starboard-side outer end and said starboard side inner end and being in fluid communication with said interior of said starboard-side inflatable float, said elongated starboard-side body being generally rectangular with a starboard-side length approximately equivalent to said port-side length, said elongated starboard-side body being formed from a durable and flexible waterproof starboard-side body material configured to expand a starboard-side width of said elongated starboard-side body when said interior of said starboard-side inflatable float is filled with air through said starboard-side compressed air line, said starboard-side width being minimized when said interior of said starboard-side inflatable float is emptied of compressed air and being maximized when said interior of said starboard-side inflatable float is filled with compressed air, said compressed air being pumped into and out of said interior of said starboard-side inflatable float via said starboard-side compressed air line when said starboard-side compressed air line is in fluid communication with said starboard-side valve while said starboard-side valve cap is removed from said starboard-side valve; and a plurality of connecting cables coupling said port-side inflatable float to said starboard-side inflatable float, said plurality of connecting cables being affixed to and extending between said port-side connecting tab and said starboard-side connecting tab, said plurality of connecting cables being between 1 foot and 2 feet in length and formed of a waterproof cable material, said waterproof cable material being durable enough to withstand extended periods of submersion underwater without weakening or disintegrating.

17. A method for lifting a boat with a port-side boat cleat and a starboard-side boat cleat above a body of water at a docking site and supporting said boat above said body of water at said docking site, said method comprising:

placing an inflatable lift assembly into said body of water at said docking site, said inflatable lift assembly comprising, a port-side inflatable float having a port-side outer end opposite a port-side inner end, a port-side valve being attached to said port-side inflatable float and in fluid communication with an interior of said port-side inflatable float, a port-side anchor tab being attached to and extending from said port-side outer end, said port-side anchor tab being configured to receive and connect with a port-side tie, said port-side tie being configured to removably attach said port-side anchor tab with said boat, and a port-side connecting tab being attached to and extending outwardly from said port-side inner end, wherein said port-side inflatable float has an elongated port-side body extending between said port-side outer end and said port-side inner end and being in fluid communication with said interior of said port-side inflatable float, said elongated port-side body being configured to expand a port-side width of said elongated port-side body when said interior of said port-side inflatable float is filled with air, said port-side width being minimized when said interior of said port-side inflatable float is emptied of compressed air and being maximized when said interior of said port-side inflatable float is filled with compressed air;

a starboard-side inflatable float having a starboard-side outer end opposite a starboard-side inner end, a starboard-side valve being attached to said starboard-side inflatable float and in fluid communication with an interior of said starboard-side inflatable float, a starboard-side anchor tab being attached to and extending outwardly from said starboard-side outer end, said starboard-side anchor tab being configured to receive a starboard-side tie, said starboard-side tie being configured to removably attach said starboard-side anchor tab with said boat, and a starboard-side connecting tab being attached to and extending outwardly from said starboard-side inner end, wherein said starboard-side inflatable float has an elongated starboard-side body extending between said starboard-side outer end and said starboard side inner end and being in fluid communication with said interior of said starboard-side inflatable float, said elongated starboard-side body being configured to expand a starboard-side width of said elongated starboard-side body when said interior of said starboard-side inflatable float is filled with air, said starboard-side width being minimized when said interior of said starboard-side inflatable float is emptied of compressed air and being maximized when said interior of said starboard-side inflatable float is filled with compressed air; and a plurality of connecting cables coupling said port-side inflatable float to said starboard-side inflatable float, said plurality of connecting cables being affixed to and extending between said port-side connecting tab and said starboard-side connecting tab;

connecting an air pump to said port-side valve and to said starboard-side valve via a port-side compressed air line and a starboard-side compressed air line;

placing said boat directly over said inflatable lift assembly, said port-side boat cleat being generally aligned with said port-side anchor tab and said starboard-side boat cleat being generally aligned with said starboard-side anchor tab;

lifting said port-side outer end and said starboard-side outer end to raise and align said port-side anchor tab and said starboard-side anchor tab with said port-side boat cleat and said starboard-side boat cleat;

securing said port-side anchor tab to said port-side boat cleat using said port-side tie;

securing said starboard-side anchor tab to said starboard-side boat cleat using said starboard-side tie; and inflating said port-side inflatable float and said starboard-side inflatable float using said air pump to fill said interior of said port-side inflatable float with compressed air and to fill said interior of said starboard-side inflatable float with compressed air.

18. The method of claim 17, further comprising:

disconnecting said port-side compressed air line from said port-side valve;

securing a port-side valve cap onto said port-side valve, said port-side valve cap being tethered to said port-side valve and configured to form an air-tight seal over said port-side valve when said port-side valve cap is secured onto said port-side valve;

disconnecting said starboard-side compressed air line from said starboard-side valve; and securing a starboard-side valve cap onto said starboard-side valve, said starboard-side valve cap being tethered to said starboard-side valve and configured to form an air-tight seal over said starboard-side valve when said starboard-side valve cap is secured onto said starboard-side valve.

19. The method of claim 17, wherein said elongated port-side body is generally rectangular with a port-side body length of between 4 feet and 12 feet, and wherein said elongated starboard-side body has substantially similar dimensions as said elongated port-side body.

20. The method of claim 17, wherein said elongated port-side body has a port-side body length of between 1 foot and 4 feet, and wherein said elongated starboard-side body has substantially similar dimensions as said elongated port-side body.

* * * * *